US005183203A

United States Patent [19]

Sanders

[11] Patent Number: 5,183,203

[45] Date of Patent: Feb. 2, 1993

[54] MULTIPLE PURPOSE CERTIFIED MAIL ENVELOPE ASSEMBLY

[76] Inventor: Raymond W. Sanders, 6368 Sharlene Dr., Cincinnati, Ohio 45248

[21] Appl. No.: 770,797

[22] Filed: Oct. 3, 1991

[51] Int. Cl.[5] ..... B65D 27/00

[52] U.S. Cl. ..... 229/300; 229/69; 229/70

[58] Field of Search ..... 229/69, 70, 300

[56] References Cited

U.S. PATENT DOCUMENTS

| | | | |
|---|---|---|---|
| 89,507 | 4/1869 | Saladee | 229/70 |
| 444,979 | 1/1891 | Harrison et al. . | |
| 1,491,675 | 4/1924 | Conklin | 229/300 |
| 1,568,880 | 1/1926 | Conklin | 229/300 |
| 2,153,504 | 4/1939 | Didier | 229/70 |
| 2,304,523 | 12/1942 | Young | 229/69 |
| 2,824,685 | 2/1958 | Patton | 229/69 |
| 3,304,103 | 4/1967 | Bensler, Sr. et al. . | |
| 3,419,286 | 12/1968 | Noonan et al. . | |
| 3,482,763 | 12/1969 | Carrigan | 229/69 |
| 3,507,519 | 4/1970 | McNabb . | |
| 3,726,471 | 4/1973 | Kalb . | |
| 3,933,094 | 1/1976 | Murphy et al. | 229/68 R |
| 3,987,960 | 10/1976 | Gardiner . | |
| 3,993,299 | 11/1976 | O'Brien et al. . | |
| 4,211,434 | 7/1980 | Reese . | |
| 4,213,639 | 7/1980 | Absler et al. . | |
| 4,230,262 | 10/1980 | Denay et al. . | |
| 4,236,731 | 12/1980 | Hektoen . | |
| 4,346,916 | 8/1982 | Shelton . | |
| 4,418,865 | 12/1983 | Bowen . | |
| 4,429,827 | 2/1984 | Murray | 229/68 R |
| 4,493,496 | 1/1985 | Kaluza . | |
| 4,682,793 | 7/1987 | Walz | 229/69 |
| 5,060,847 | 10/1991 | Angus | 229/70 |

FOREIGN PATENT DOCUMENTS 115350 11/1899 Fed. Rep. of Germany ..... 229/70

*Primary Examiner*—Stephen P. Garbe
*Attorney, Agent, or Firm*—Frost & Jacobs

[57] ABSTRACT

A continuous strip of envelope assemblies for Certified Mail. The strip comprises a continuous first paper ply having front and rear surfaces and continuous longitudinal edges. The first ply is divided long into equal length segments by transversely extending lines of perforations. Each segment is divided into first and second portions by a transversely extending fold line. Each first portion constitutes an envelope assembly front panel and each second portion comprises an envelope assembly closure flap. A second paper ply comprises discrete sheets equal to the number of front panels, and each comprising an envelope assembly rear panel. Each rear panel is affixed to a front panel along its sides and bottom with the envelope opening located along the transverse fold line. A return receipt card is removably affixed to the front of each flap. The rear surface of the return receipt card is preprinted with the sender's address. Bands of remoistenable glue are provided on the rear surface of each flap for sealing the flap on the front surface of its respective rear panel to close the envelope opening. A Certified Mail endorsement and a return receipt request is preprinted on each front panel. The strip is of such width as to be feedable into a computer printer for application to each envelope assembly of the required information. Each envelope assembly is severable from the strip along that transverse line of perforations between its closure flap and the front panel of the next adjacent evnelope assembly.

13 Claims, 4 Drawing Sheets

MULTIPLE PURPOSE CERTIFIED MAIL ENVELOPE ASSEMBLY

TECHNICAL FIELD

The invention relates to an envelope assembly for mailing documents by Certified Mail, and more particularly to such an envelope assembly wherein the Certified Mail endorsement is on the front panel of the envelope assembly, the return receipt is affixed to the envelope assembly closure flap, and the envelope assembly, itself, may constitute a part of a continuous strip of such envelope assemblies.

BACKGROUND ART

The present invention is directed to an envelope assembly for use with Certified Mail. The mailing of a document or the like by Certified Mail, including the manual filling out of the requisite postal service forms, is time-consuming. The preparation of Certified Mail becomes particularly labor-intensive when large quantities of such mail are generated.

As a consequence, prior art workers have devised various types of document mailers and systems for Certified Mail. This is exemplified, for example, in U.S. Pat. No. 4,429,827. Generally, the prior art mailers and systems are characterized by complexity of construction and use.

Prior art workers have also devised various types of envelopes for Certified Mail, severable from a continuous strip of such envelopes. In the most common practice, the return receipt form is removably affixed to the face of the envelope adjacent one end thereof, or constitutes a separate portion extending from one end of the envelope with a line of perforations along which it may be severed from the adjacent end of the envelope. Many of these last-mentioned prior art mailers are of such nature that the contents of the envelope is located within the envelope at the time of assembly thereof. In other words, these envelopes are not intended to have a document placed in them after the envelope has been assembled and, therefore, they do not constitute multipurpose envelopes. Envelopes of this general type are usually too wide for use with most conventional computer printers, and optical bar code scanners.

The present invention is based upon the discovery that a simple envelope assembly can be provided which overcomes most of the above-enumerated deficiencies. The envelope assembly can be made of such width that it can be fed through a computer printer and an optical bar code scanner. The envelope assembly comprises a first ply having a transverse fold line formed therein which divides the first ply into a front panel for the envelope assembly and a closure flap therefor. The envelope assembly has a second ply glued along three of its edges to the rear surface of the front panel portion of the first ply, to form the rear panel of the envelope assembly. The Certified Mail endorsement is printed on the front panel portion of the envelope assembly, and the Certified Mail return receipt is detachably affixed to the closure flap.

The transverse opening of the envelope is of such width that an 8 ½" wide document can easily be inserted therethrough. The envelope flap is provided with one or more strips of remoistenable glue so that once the flap is sealed, the document is securely contained within the envelope assembly. The necessary information for the Certified Mail return receipt, the Certified Mail endorsement, the sender's return address and the recipient's address may be applied through the use of a conventional computer and computer printer. No preparation time is required for the envelope assembly, such as folding or other manipulation. A bar code may be applied to the envelope assembly and use may be made of a pre-selected block of article mail numbers obtained from the post office.

The envelope assembly of the present invention can be made in the form of a continuous strip of such assemblies provided in roll form or zig-zag fold form for feeding through a computer printer. To this end, the strip of envelope assemblies may be provided with detachable perforated edge portions for the drive of a computer printer. For certain types of laser printers and the like, the envelopes may be detached from the strip and individually fed therethrough.

These and other advantages of the envelope assembly of the present invention will be apparent hereinafter.

DISCLOSURE OF THE INVENTION

According to the invention there is provided a continuous strip of Certified Mail envelope assemblies for feeding through a computer printer means. The continuous strip comprises a continuous first paper ply having a front surface and a rear surface and continuous longitudinal edges. The first ply is divided longitudinally into equal length segments by lines of perforations extending transversely of the first ply. Each segment, in turn, is divided into first and second portions by a fold line extending transversely of the ply. Each first portion constitutes an envelope assembly front panel. Each second portion constitutes an envelope assembly closure flap.

A second ply comprises discrete paper sheets equal in number to the number of envelope assembly front panels. Each second ply sheet is of the same dimensions as the front panels and has its rear surface glued to the rear surface of one of the front panels longitudinally of the strip along the sides thereof and transversely of the strip near the adjacent one of the transverse lines of perforations. Each second ply sheet comprises the back panel of its respective envelope assembly. Each envelope assembly has an envelope opening between its front and rear panels extending transversely of the strip adjacent the fold line between its respective front panel and closure flap.

A return receipt card, having front and rear surfaces, is removably affixed to the front surface of each envelope assembly flap, with its rear surface facing the front surface of its respective flap. The sender's address is preprinted on the rear surface of each return receipt card.

Bands of remoistenable glue are provided on the rear surface of each envelope assembly closure flap for adhering the rear surface of the flap to the front surface of its respective rear panel, to close the envelope opening. A Certified Mail endorsement is preprinted on each front panel centrally thereof and adjacent its respective fold line. A return receipt request is preprinted on each front panel adjacent and beneath its Certified Mail endorsement.

The strip of envelope assemblies is of such width that it can be fed into a computer printer means for application to each envelope assembly of the required information including article number on the front surface of its return receipt card, the article number on its Certified Mail endorsement, and the sender's return address and the recipient's address on its front panel.

The strip of Certified Mail envelope assemblies may be provided with narrow, removable, perforated strips along its longitudinal edges for use with computer printer means of the type having sprocket-like drives. Each envelope assembly is severable from the strip along that transverse line of perforations located between its closure flap and the front panel of the next adjacent envelope assembly.

DETAILED DESCRIPTION OF THE INVENTION

Figure 1:
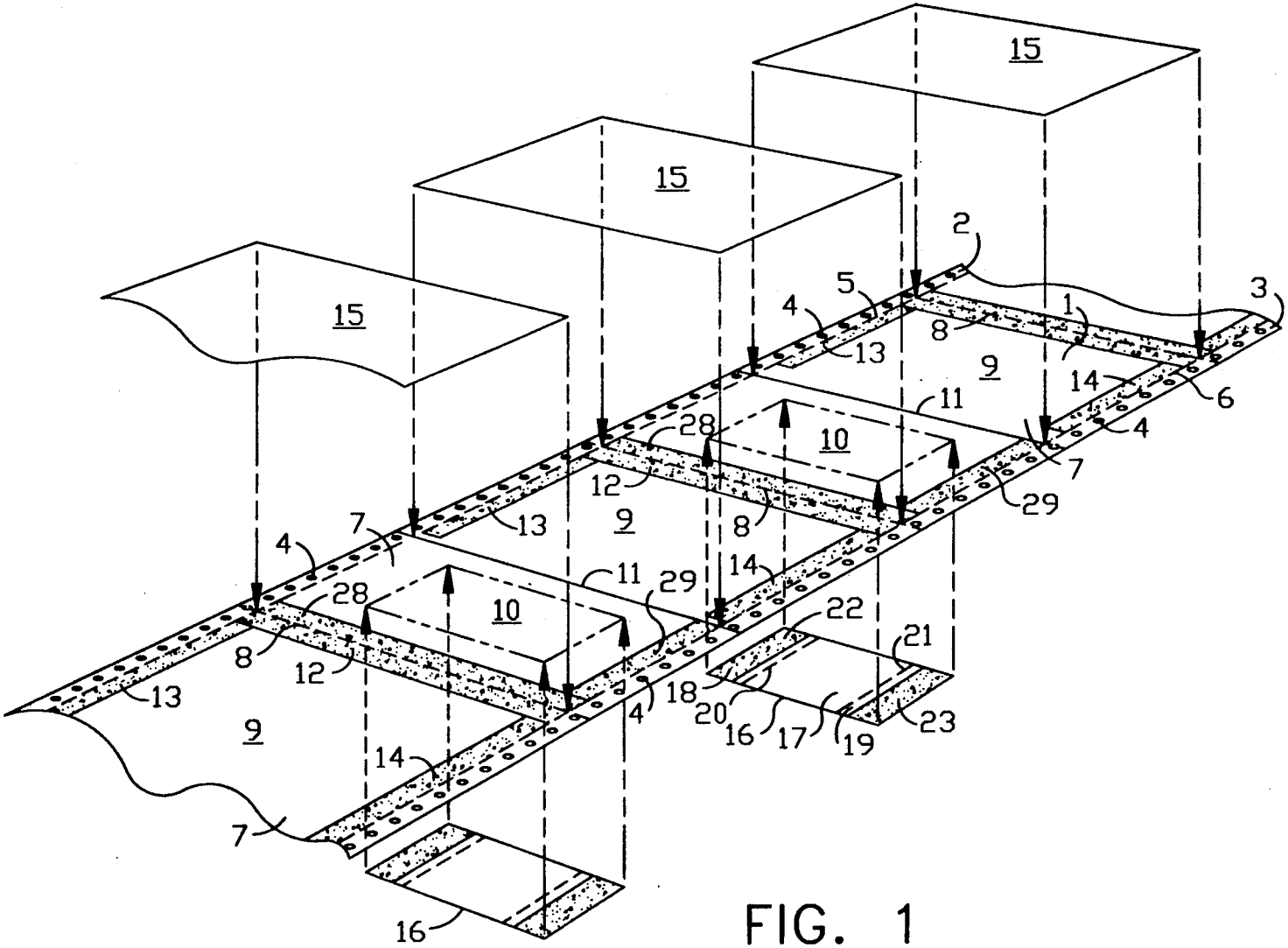
FIG. 1 is a fragmentary, exploded, perspective view of a continuous strip of envelope assemblies of the present invention.

Throughout the Figures, like parts have been given like index numerals. Reference is first made to FIG. 1. FIG. 1 is an exploded perspective view and illustrates a first ply in the form of a continuous strip and designated by index numeral 1. In the embodiment illustrated, the longitudinal edges of the first ply 1 are provided with additional narrow strips 2 and 3. The narrow strips 2 and 3 are each provided with holes 4 evenly spaced therealong. The strips 2 and 3 are conventional drive strips enabling advancement of the first ply 1 through a conventional computer printer having a sprocket-type advancing mechanism, as is well known in the art. The narrow strips 2 and 3 are severable from the first ply 1 along longitudinally extending lines of perforation 5 and 6, respectively. The narrow drive strips 2 and 3 are optional, and it is within the scope of the invention to eliminate them from the first ply 1.

The strip-like first ply 1 is divided longitudinally into equal segments 7 by transverse lines of perforations 8. Each segment 7 of the strip-like first ply 1 is divided into two parts 9 and 10 by a transverse fold line 11. As will be apparent hereinafter, each of the parts 9 will constitute the front panel of an envelope assembly of the present invention. Each adjacent part 10 will constitute the closure flap of the same envelope assembly.

Figure 2:
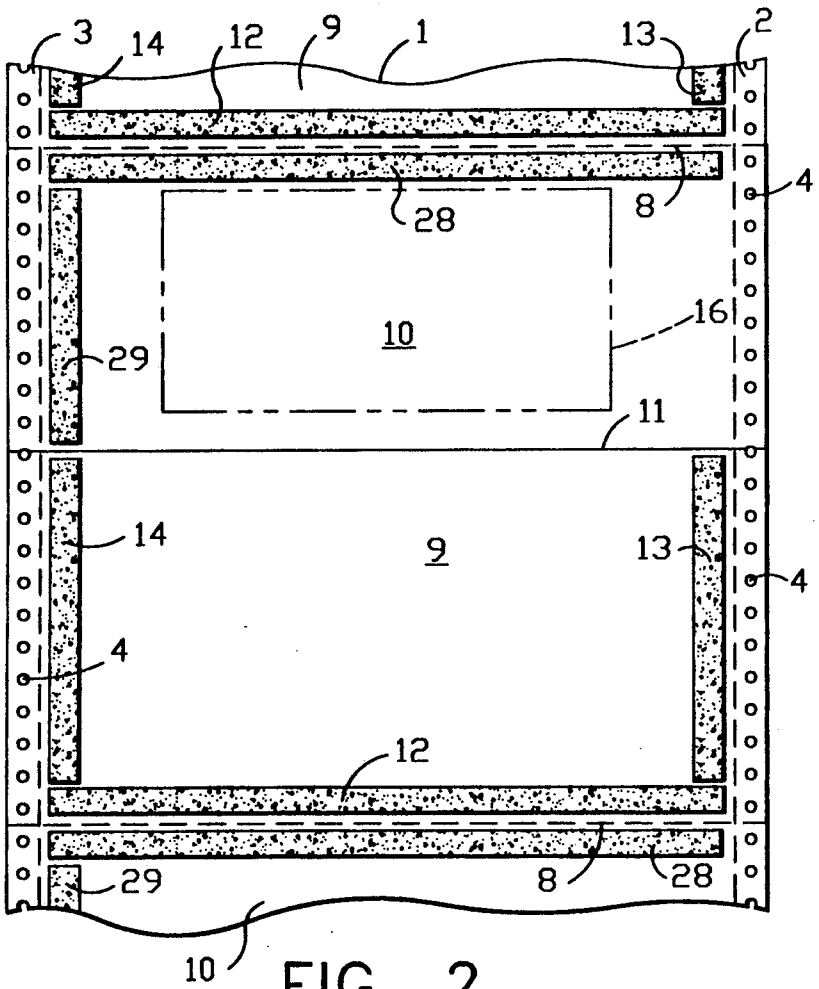
FIG. 2 is a fragmentary elevational view of the rear surface of the first continuous ply of FIG. 1.

As is shown in the perspective view of FIG. 1 and the plan view of FIG. 2, each front panel portion 9 of the elongated, strip-like first ply 1 is provided with a narrow band of glue 12 adjacent its lower edge, as defined by the adjacent transverse line of perforations 8. In addition, each front panel part of the elongated ply 1 is provided with a narrow band of glue along each of its sides and extending from the band of glue 12 to a point adjacent fold line 11. These side bands of glue are indicated at 13 and 14. The purpose of glue bands 12, 13 and 14 will be apparent hereinafter.

Each envelope assembly also incorporates a second ply in the form of a rectangular sheet 15 (see FIG. 1). Each second ply 15 is of the same dimensions as a front panel portion 9 of the first ply 1. Each second ply 15 comprises the rear panel of an envelope assembly and is adhered to a front panel portion 9 of the first ply 1 by means of the glue bands 12, 13 and 14 thereon. As a consequence, each envelope assembly comprises a front panel 9, a rear panel 15 and a closure flap 10. It would be within the scope of the invention to apply the glue bands 12, 13 and 14 to each second ply 15, rather than to each front panel part 9, as would be obvious to one skilled in the art.

Figure 3:
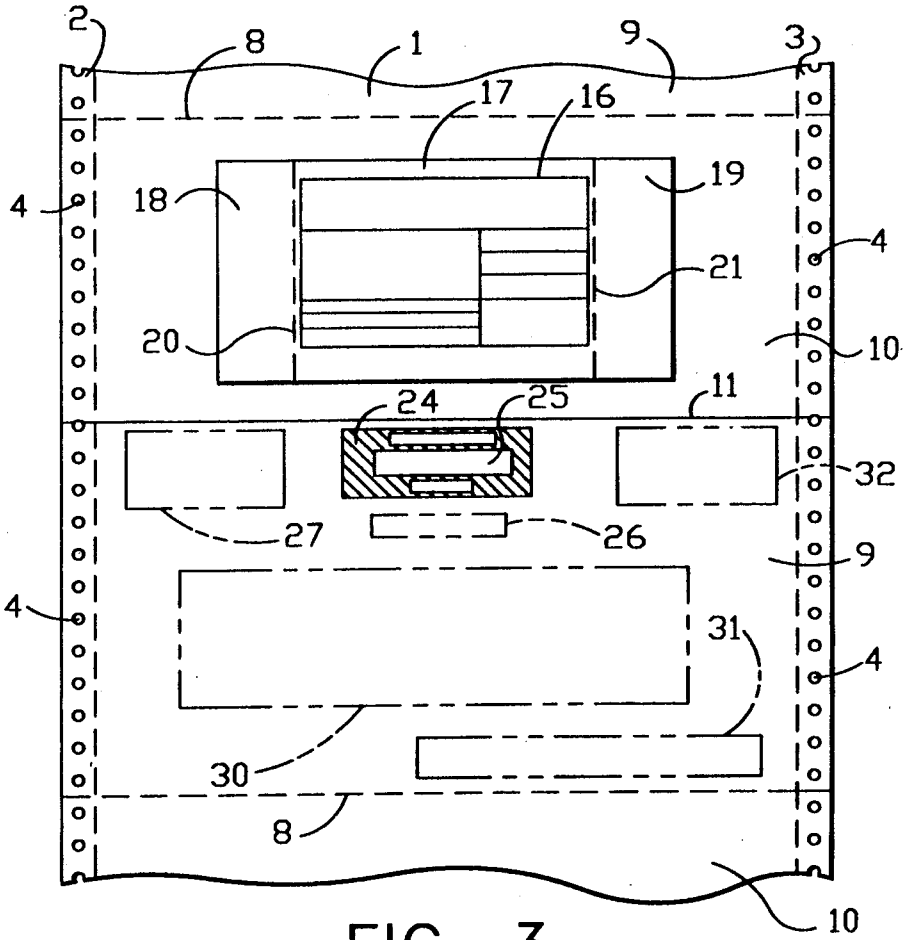
FIG. 3 is a fragmentary elevational view of the front surface of the first ply of FIG. 1.

It will be apparent from FIGS. 1 and 3, that a Certified Mail return receipt card 16 is affixed to the outside surface of each closure flap part 10 of the strip-like first ply 1. Each Certified Mail return receipt card 16 comprises a rectangular body portion 17 with extended end portions 18 and 19 and transverse lines of perforations 20 and 21 between the end portions 18 and 19 and the main body portion 17. The end portions 18 and 19 are provided with bands of glue 22 and 23, respectively, by which the return receipt card is affixed to its respective flap portion of first ply 1. The lines of perforation 20 and 21 enable the main body portion 17 of the return receipt card 16 to be severed from its respective closure flap portion 10. That surface of the main body portion 17 (shown in FIG. 1) which faces its respective closure flap 10 is preprinted with the sender's address. The opposite side of the main body portion 17 of the Certified Mail return receipt card (shown in FIGS. 3, 4 and 6) is provided with spaces to be filled out in accordance with the instructions of the United States Postal Service.

The envelope assembly of the present invention is primarily intended for use by senders who generate large quantities of Certified Mail. It is for this reason that the return receipt card 16 is preprinted with the sender's address. For the same reason, the outside surface of each front panel portion 9 of the first ply 1 is preprinted with a Certified Mail endorsement 24. The Certified Mail endorsement comprises a rectangular area printed in green ink with a white rectangular area 25 centered within it. In the green area above the white rectangle 25 the word "CERTIFIED" (not shown) appears in white. Similarly, in the green area below the white rectangle 25, the word "MAIL" (not shown) appears in white. The Certified Mail endorsement 24 is preferably centered at the top of the front panel 9.

Below the Certified Mail endorsement 24 the words "RETURN RECEIPT REQUESTED" (not shown) are printed in the area designated by the broken line rectangle 26. To the left of the Certified Mail endorsement 24 the sender's return address (not shown) may be preprinted on each front panel 9 in the area designated by broken line rectangle 27. This is particularly true in instances where the sender generates a sufficient quantity of Certified Mail to justify the pre-printing of his return address.

The strip of envelope assemblies of FIGS. 1-3 is completed by applying bands of remoistenable glue to the rear surface of each closure flap 10. As is most clearly shown in FIG. 2, it is preferable that each closure flap 10 be provided with a transverse band of glue 28 near its upper edge as defined by the adjacent transverse line of perforations 8, and an additional band of glue 29 along the left rear side edge of the flap. It would be within the scope of the invention to provide the flap 10 with a band of remoistenable glue along its right end edge, as well.

In an exemplary embodiment of the strip of envelope assemblies illustrated in FIGS. 1-3, the first ply 1 and the individual second plies 15 were made of 24 lb. white paper. The front panel portions 9 of the first ply had a maximum width of 9 ¾" (not including drive strips 2 and 3), and a height of 6 ⅛". The glue bands 12, 13 and 14 were of such width that the inside dimensions of each envelope assembly (i.e., the space between the front panel 9 and the rear panel 15) were 9" in width and 5 ¾" in height. Each closure flap portion was of the same width as the front panel 9 and the rear panel 15. Each closure flap had a length of 5". This height dimension should be not less than 4 ¾" or more than 5 ¾". The preprinted Certified Mail endorsement 24, printed in green ink with the words "CERTIFIED MAIL" in white was 2 15/16" wide and 1 1/16" high. The white rectangle 25 of the endorsement was 2 ⅛" wide and 7/16" high. The words "RETURN RECEIPT REQUESTED" were printed in the area 26 using black ink and letters ⅛" high, and were spaced ¼" below the Certified Mail endorsement 24. The return address 27 was printed in black ink using letters 1/16" high. The return address was started ⅜" from the top edge of front panel 9 and ⅜" from the left edge of front panel 9.

A Certified Mail return receipt card 16 printed with black ink on 110 lb. green index stock. The form on the front face of the Certified Mail return receipt card was also preprinted with a "X" to indicate the type of service desired, i.e., "CERTIFIED." The sender's return address was printed on the back of the Certified Mail return receipt card in ⅛" letters.

The envelope assembly of the present invention having been described in detail, the manner in which it is used can now be set forth.

The strip of envelope assemblies of the present invention is appropriately introduced into the feed mechanism of a computer printer. In instances where the computer printer does not have a sprocket-type feed, as is the case in certain laser printers and the like, the envelope assemblies may be severed individually from the strip and hand-fed into the printer.

The computer will be preprogrammed to enter the addressee's address and the article number on the Certified Return Receipt card 16. The article number will also be entered in the white rectangle 25 of the Certified Mail endorsement 24. Thereafter, the addressee's address is printed on the front panel 9 of the envelope assembly in the area indicated by broken line rectangle 30. A bar code may also be imprinted on the front panel 9 of the envelope assembly in the area designated by broken line rectangle 31. If the sender's return address is not pre-printed on front panel 9, it may be applied in the area designated by broken line rectangle 27 by the printer means. Thereafter, it is only necessary to introduce the desired documents into the envelope assembly between front and rear panels 9 and 15 and to seal the flap 10. Postage may be added in any conventional manner in the area designated by broken line rectangle 32.

Figure 5:
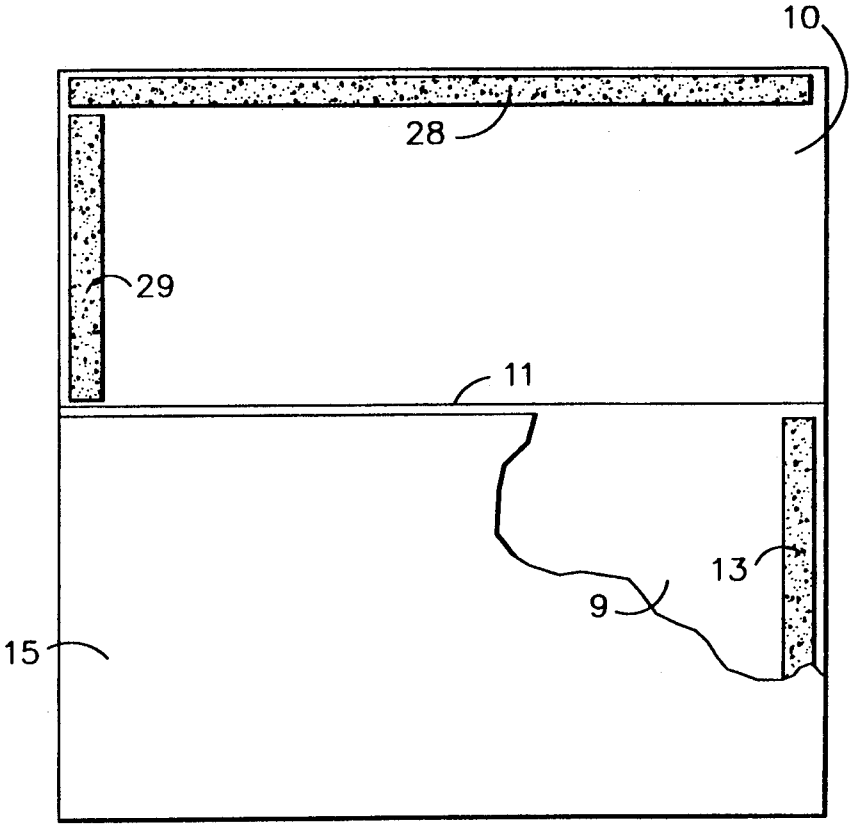
FIG. 5 is a rear elevational view of the envelope assembly of the present invention, partly in cross-section, and again showing the flap in its open position.
Figure 4:
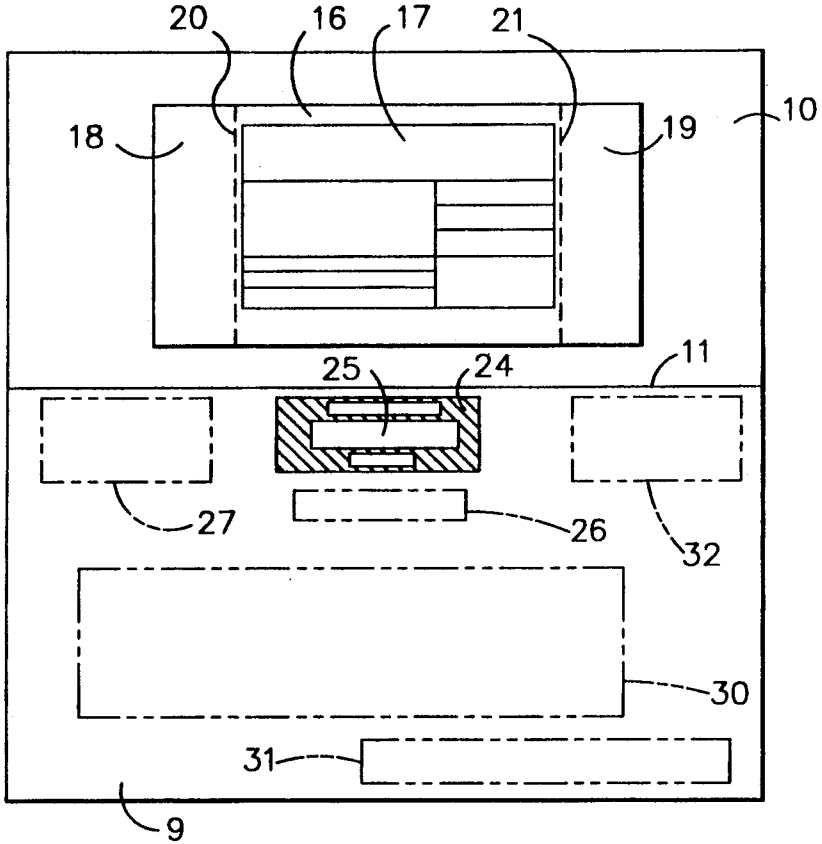
FIG. 4 is an elevational view of the front of the envelope assembly with its flap in open position.
Figure 6:
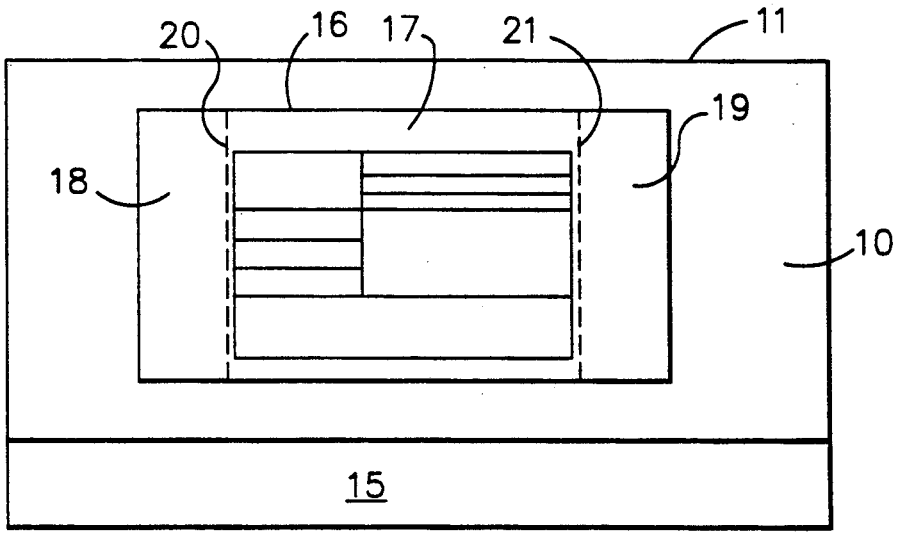
FIG. 6 is a rear elevational view of the envelope assembly of the present invention with the flap in closed position.
Figure 7:
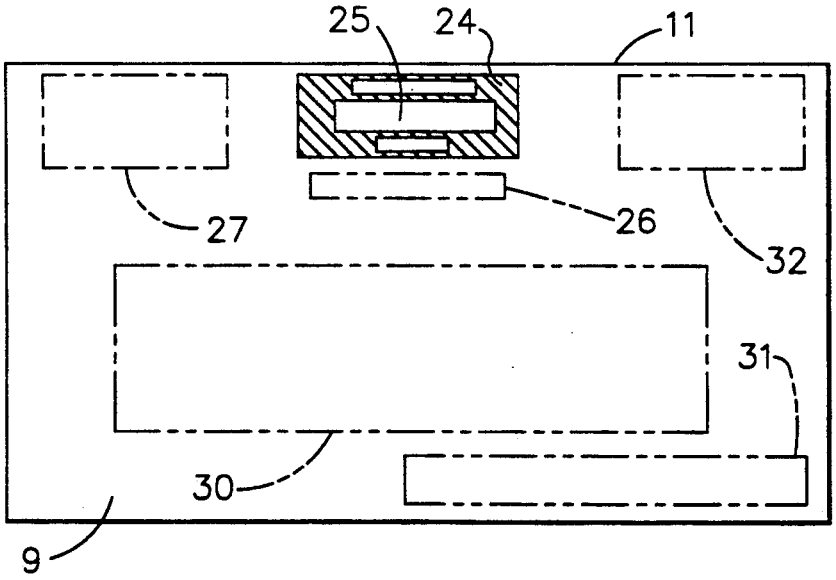
FIG. 7 is a front elevational view of the envelope assembly of the present invention with the flap in closed position.

FIGS. 4 and 5 illustrate the envelope ready for receipt of the documents to be mailed. It will be noted that the perforated strips 2 and 3 have been removed from the envelope assembly. FIGS. 6 and 7 illustrate the envelope assembly with the flap 10 sealed in place. The envelope assembly and its contents are then ready to be mailed.

From the above description it will be apparent that the envelope assembly of the present invention provides numerous advantages. For example, the contents of the envelope assembly are more secure because there is no line of perforations where the return receipt 16 folds to the rear of the assembly, the return receipt 16 being affixed directly to closure flap 10. The envelope assembly enables any appropriate document or documents to be inserted therein, rendering the envelope assembly a multi-purpose envelope assembly, as opposed to those prior art structures wherein the contents of the envelope are inserted during assembly of the envelope. The 9" wide opening of the envelope assembly of the present invention makes for easy insertion of any document having a width of up to 8 ½". The width of the envelope assembly is such that it can be used with most types of computer printers.

There is no preparation time to render the envelope usable for Certified Mail and no special manipulation is required. The Certified Mail endorsement 24 and the Certified Mail return receipt card 16 are together on the same envelope, eliminating any chance of mix-up of article numbers.

The envelope assembly of the present invention eliminates the manual preparation of a FIRM MAILING BOOK such as the United States Postal Service Form 3877. The computer used in association with the envelope assembly will generate a FIRM MAILING BOOK, PS Form 3877 including the Certified Mail Number, the name and address of the addressee, and the date of mailing. The envelope assembly allows the use of a bar code at the time of printing on the envelope by the computer printer. The envelope is so sized that it will readily go through an optical bar code scanner. The envelope assembly also allows the use of a preselected block of article numbers obtained from the Post Office.

Modifications may be made in the invention without departing from the spirit of it.

What is claimed is:

1. A continuous strip of Certified Mail envelope assemblies for feeding through a computer printer, said continuous strip comprising a continuous first paper ply having a front surface and a rear surface and continuous longitudinal edges, said first ply being divided longitudinally into equal length segments by transversely extending lines of perforations, each such segment being divided into first and second portions by a transversely extending fold line, each first portion comprising an envelope assembly front panel, each second portion comprising an envelope assembly closure flap, a second ply comprising discrete paper sheets equal in number to the number of said envelope assembly front panels, each second ply sheet having a front surface and a rear surface, each second ply sheet having its rear surface glued to said rear surface of its respective front panel longitudinally of said strip along the sides thereof and transversely of said strip near the adjacent one of said transverse lines of perforations, each second ply sheet comprising the rear panel of its envelope assembly, each envelope assembly having an envelope opening between its front and rear panels extending transversely of said strip adjacent said fold line between its respective front panel and closure flap, a return receipt card having front and rear surfaces being removably affixed to said front surface of each envelope assembly flap, said rear surface of said return receipt card facing said front surface of its respective flap and having the sender's address pre-printed thereon, bands of remoistenable glue on said rear surface of each envelope assembly closure flap for adhering said rear surface of said flap to said front surface of its respective rear panel to close said envelope opening, a Certified Mail endorsement being pre-printed on each front panel centrally thereof and adjacent its respective fold line, a return receipt request pre-printed on each front panel adjacent and beneath its Certified Mail endorsement, each envelope assembly being severable from said strip along that transverse line of perforations between its closure flap and the front panel of the next adjacent envelope assembly.

2. The strip claimed in claim 1 wherein each envelope assembly has a width up to 9 ¾".

3. The strip claimed in claim 1 wherein said envelope opening is 9" wide.

4. The strip claimed in claim 1 including a bar code on said front face of each front panel.

5. The strip claimed in claim 1 wherein said bands of remoistenable glue on said rear surface of each flap comprise a first glue band adjacent the uppermost edge of said flap and a second glue band along the left rear side edge of said flap.

6. The strip claimed in claim 1 wherein said return address of the sender is pre-printed on said front surface of each of said front panels.

7. The strip claimed in claim 1 including a narrow perforated drive strip extending along each longitudinal edge of said first ply, a line of perforations between each narrow strip and said first ply along which each narrow strip is severable from said first ply.

8. An envelope assembly for Certified Mail comprising a front panel having an exterior surface, an interior surface, a bottom edge, side edges and an upper edge defined by a fold line between said panel and a closure flap integral therewith, a rear panel coextensive with said front panel and having an exterior surface, an interior surface, a bottom edge, side edges and a top edge, said front and rear panels being glued together along their bottom and side edges with their interior surfaces opposed, said top edges of said front and rear panels defining an opening to the interior of said envelope assembly between said opposed interior surfaces thereof for the receipt of documents, said flap having exterior and interior surfaces and being shiftable about said fold line between an open position and a position closing said opening and overlying a portion of said exterior surface of said rear panel, means to seal said flap to said rear panel, a Certified Mail return receipt card having front and rear surfaces, said flap being larger than said return receipt card, said return receipt card being detachably mounted on said flap with its rear surface opposed thereto, the sender's address being pre-printed on said return receipt card rear surface, a Certified Mail endorsement being pre-printed on said exterior surface of said front panel together with a request for return receipt thereunder.

9. The envelope assembly claimed in claim 8 wherein said envelope assembly has a width up to 9 ¾"

10. The envelope assembly claimed in claim 8 wherein said opening has a width of 9".

11. The envelope assembly claimed in claim 8 including a bar code on said exterior surface of said front panel.

12. The envelope assembly claimed in claim 8 wherein said means to seal said flap to said rear panel comprises a first band of remoistenable glue on said interior surface of said flap adjacent the uppermost edge thereof and a second band of remoistenable glue on said interior surface of said flap adjacent the left side edge thereof.

13. The envelope assembly claimed in claim 8 wherein said return address of the sender is pre-printed on the exterior surface of said front panel.

* * * * *